United States Patent [19]

Colgan

[11] 3,930,698

[45] Jan. 6, 1976

[54] PLATE HOLDER AND DISPENSER

[76] Inventor: Bruce W. Colgan, 1 Stagecoach Road, Northfield, Vt. 05663

[22] Filed: Oct. 21, 1974

[21] Appl. No.: 516,181

[52] U.S. Cl. ..... 312/43; 312/243; 221/282

[51] Int. Cl.[2] ..... A47F 1/00

[58] Field of Search ..... 221/27, 29, 281–284, 221/289, 296, 303, 304, 311, 312 C, 312 R, 309, 305, 60, 63, 33, 45, 310; 206/44.12; 312/256, 243, 42, 43, 9

[56] References Cited

UNITED STATES PATENTS

| | | | |
|---|---|---|---|
| 1,564,529 | 12/1925 | Cartet | 312/43 |
| 1,769,541 | 7/1930 | Patcell | 312/256 |
| 2,115,720 | 5/1938 | Holmes | 312/24 S |
| 3,164,298 | 1/1965 | Repko | 221/282 |
| 3,193,139 | 7/1965 | Iannone et al. | 221/308 |
| 3,342,375 | 9/1967 | Johnson et al. | 221/308 |
| 3,446,543 | 5/1969 | Mathews | 312/42 |

FOREIGN PATENTS OR APPLICATIONS

| | | | |
|---|---|---|---|
| 388,878 | 8/1908 | France | 312/42 |

*Primary Examiner*—Robert B. Reeves
*Assistant Examiner*—H. Grant Skaggs
*Attorney, Agent, or Firm*—Wolf, Greenfield & Sacks

[57] ABSTRACT

A paper plate dispenser houses a stack of plates and is provided with specially formed openings in its bottom and side walls to enable one or more of the plates to be removed easily. Brush-like retainers are supported on the inside of the dispenser housing and engage selected portions of the plates in the stack to aid in retaining the plates within the housing. The configuration of the dispenser is such that it may be supported in a horizontal or vertical attitude to facilitate its mounting in a variety of convenient locations.

7 Claims, 5 Drawing Figures

PLATE HOLDER AND DISPENSER

SUMMARY OF THE INVENTION

This invention relates to dispensers for paper or plastic plates, bowls or similar disposable containers. The container-dispenser holds a plurality of such articles in a stacked configuration and in a manner which facilitates removal of the precise number of articles desired. The container includes a housing defined by a bottom wall, a top wall and a sidewall with the sidewall being of the same general configuration as the periphery of the plate, illustrated as circular. An arcuately shaped opening is formed in the bottom wall to expose a significant marginal portion of the lowermost plate or bowl in the stack. The stack of plates is supported, in a bottom-down configuration, by a central portion of the bottom wall which is defined in part by the arcuate cut-out portion and which supports the stack of plates at their center. The sidewall is provided with a cut-out in communication with the arcuate slot to facilitate manual gripping of the edges of the desired number of plates which are to be removed. The interior of the housing also may include a plurality of brush-like retainers which engage selected regions of the stacked plates to insure that the remaining plates in the stack will not be drawn out of the housing together with those plates which are removed.

It is among the objects of the invention to provide an improved holder-dispenser for disposable containers such as paper plates, bowls and the like.

Another object of the invention is to provide an improved dispenser of the type described in which a desired number of plates may be removed and in which the remaining plates will be retained properly within the dispenser.

A further object of the invention is to provide a container-dispenser of the type described which may be mounted in a variety of attitudes and which is effective to retain properly the stacked plates in all such attitudes.

Still another object of the invention is to provide a device of the type described which is of simple construction and which may be manufactured inexpensively.

DESCRIPTION OF THE DRAWINGS

The foregoing and other objects and advantages of the invention will be appreciated more fully from the following further description thereof, with reference to the accompanying drawings wherein:

FIG. 5 is a sectional elevation of the dispenser illustrating a modification to enable it to be employed effectively in connection with deep dish plates, bowls or the like.

DESCRIPTION OF THE PREFERRED EMBODIMENT

Figure 1:
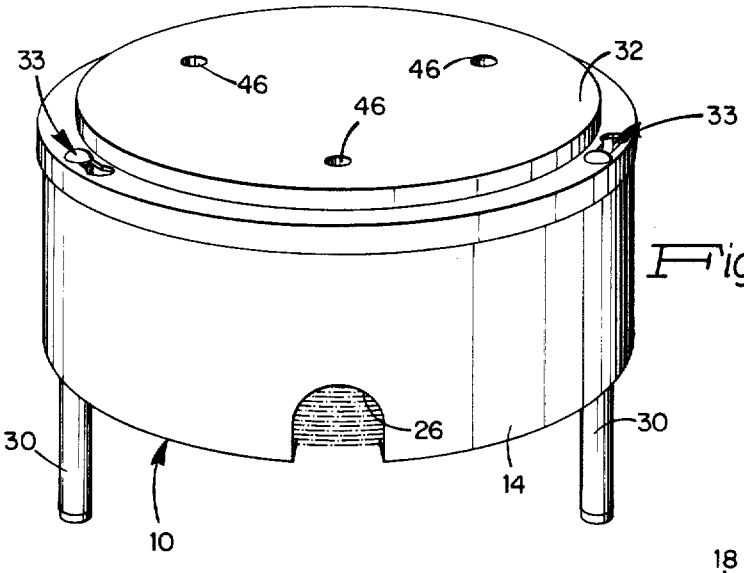
FIG. 1 is an illustration of the device in a counter top configuration.

FIG. 1 shows the dispenser in a configuration suited for use on a horizontal surface such as a countertop, table or the like. The dispenser includes a bottom section 10 having a bottom wall 12 and upstanding integral sidewall 14. The device may be made from plastic, with the bottom wall 12 and sidewall 14 being molded in an integral piece although other materials, such as sheet metal may be employed. The bottom wall 12 has an opening 16 formed therein which, in the embodiment described is of arcuate configuration. The arcuate opening 16 extends over more than half (more than 180°) of the bottom wall 12. The outer edge 18 of the opening 16 is disposed inwardly of the sidewall 14 to define an inwardly extending flange 20 about the opening 16. The inner edge 22 of the opening 16 defines a central support portion 24 of the bottom wall 12. The sidewall 14 is provided with a cut-out portion 26 which extends heightwise along the lower region of the sidewall 14 and through the flange 20 so that the cut-out 26 is in communication with the opening 16 formed in the bottom wall. The inside of the central support portion 24 may include an upwardly extending, raised member 28 to support the stack of plates as will be described. When the device is intended to be used in a horizontal position as shown in FIG. 1, it preferably is provided with a plurality of feet 30 which are secured to the flange 20 and periphery of the bottom wall 12 and extend downwardly therefrom to support the device. A cover 32 is fastenable to the upper region of the sidewall 14 by any of a variety of suitable means, such as by a snap fit or by keyhole connections as suggested in the drawings at 33.

Figure 3:
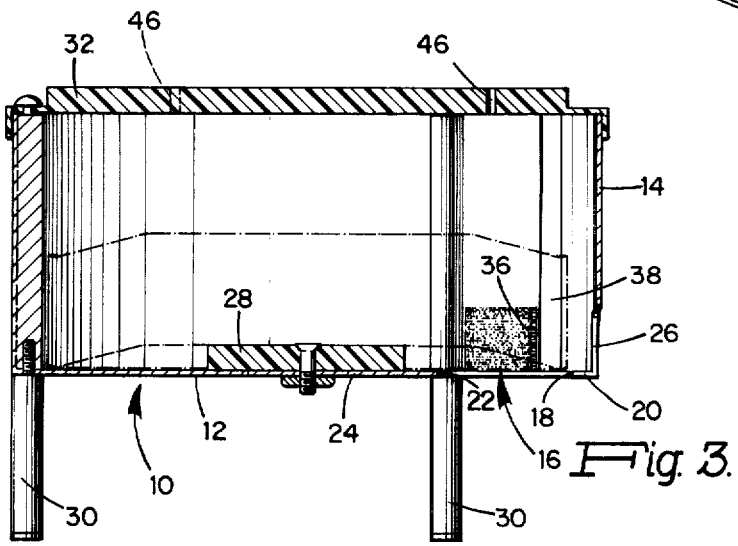
FIG. 3 is a sectional illustration of the device as seen along the line 3—3 of FIG. 2.

As shown in FIG. 3, stack of paper plates (shown in phantom) is placed in the container, bottom down so that the central portion of the lowermost plate in the stack rests on the raised portion 28 of the central support portion 24 of the bottom wall 12. The height of the raised portion 28 should be selected with respect to the depth of the dish so that the outermost edges of the stacked plates will be disposed just inwardly of the outer edge 18 of the opening 16 as defined by the flange 20. When the stack of inverted plates is thus supported, it will be seen that the edge of a plurality of the lower plates in the stack will be exposed through the side slot 26 (FIGS. 1 and 3). The user may engage the desired number of plates with his thumb and by grasping those edges and the lowermost plate in the stack through the opening 16, he may urge the gripped plates downwardly and outwardly through the opening 16. The flange 20 tends to engage the remaining plates in the stack and retards their withdrawal with the plates being removed.

Figure 2:
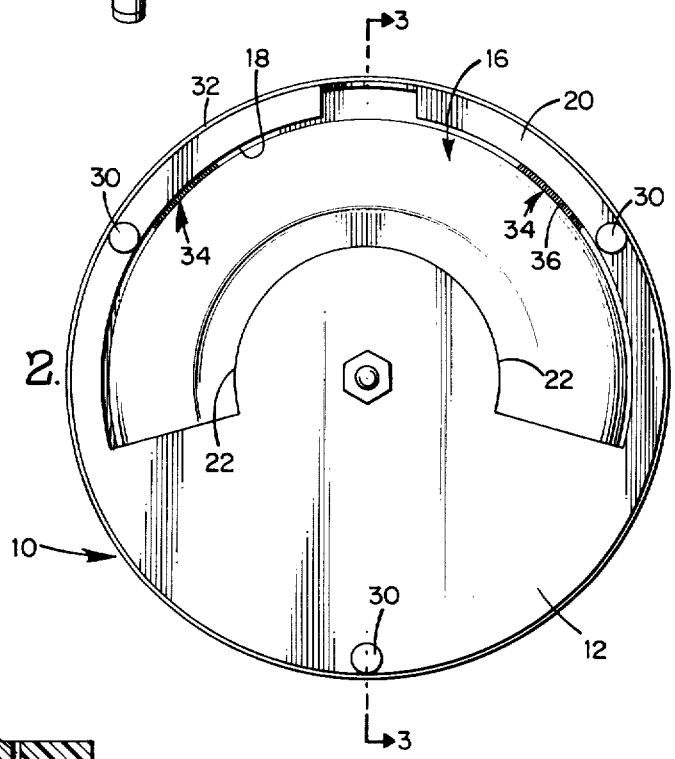
FIG. 2 is a bottom view of the embodiment shown in FIG. 1.
Figure 4:
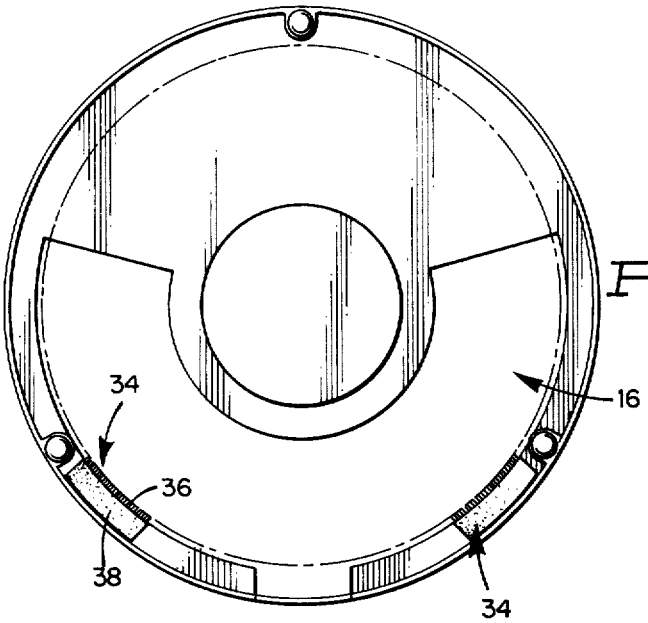
FIG. 4 is a plan view of an empty container with the top removed.

It may be desirable, in some instances, to provide further means for retarding withdrawal of the upper of the plates in the stack. To this end, retarding devices, such as the brush-like elements 34 shown in FIGS. 2–4 may be secured to the inner surface of the sidewall 14 to extend slightly inwardly to lightly engage the edges of the stacked plates. In the illustrative embodiment, one such brush-like element is disposed symmetrically with respect to the opening 16 and the thumb slot 26. The brush members 34 should extend inwardly so that they may lightly engage the edges of the stacked plates sufficiently to retard frictional withdrawal of the upper plates in the stack together with the lower plates being removed but not so heavily that they preclude the upper plates from falling down onto the central support portion 24 after the lower plates have been removed. The brush elements 34 preferably extend from the bottom of the device upwardly but not fully to the top of the sidewall 14 so that they do not interfere with the uppermost plates in the stack. The brush members 34 may be fabricated as shown in which the brush elements 36 are embedded in a plastic base 38 which, in turn, may be secured to the inside of the sidewall 14 by adhesive or other fastening means.

Figure 5:
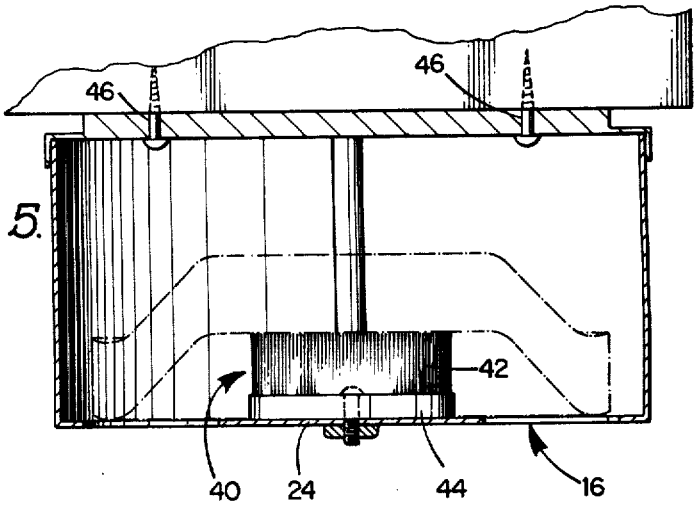

When it is desired to use the dispenser with relatively deep dished plates or bowls, it is preferred to provide an additional central support, preferably in the form of a brush-like member 40 which is secured to the central support portion 24 and extends upwardly therefrom as shown in FIG. 5. The height of the brush-like member 40 should be such that it engages the bottom of the lowermost of the inverted bowls so that the edge of the bowl is disposed just inwardly of the opening 16, in the manner described above with regard to the flatter plate configurations. The brush-like member 40 should be sufficiently flexible to enable one or more of the lower bowls in the stack to be withdrawn downwardly and outwardly through the opening 16. The supplemental brush-like elements 34 which are secured to the sidewall may also be employed to retain the remaining upper bowls in the stack within the container. The brush-like member 40 may be fabricated in a variety of ways including that described above with regard to the brush members 34, as by embedding a plurality of bristles 42 in a suitable base 44.

In some instances it may be desirable to mount the device underneath a cabinet. To this end, the cover may be provided with holes 46 by which the cover may be securely fastened to the underside of the cabinet. In this mode of supporting the device, the bottom section 10 may be separated from the permanently mounted cover to permit the dispenser to be reloaded. Alternatively, the device may be mounted along a vertical surface, such as a wall, the side of a cabinet or the like by securing the cover to such vertical surface. The dispenser may be secured in a manner such that the arcuate 16 opening and front slot 26 face downwardly. The feet 30 should be detachable so that they may be removed when the device is mounted by its cover.

The illustrated embodiments of the invention have related to generally circularly shaped dispensers intended for use with circularly shaped plates, bowls or the like. However, it should be understood that the invention is usable with equal effectiveness in connection with other than circularly shaped plates, for example, oval shapes, rectangular shapes or the like. The withdrawal opening 16 in each instance should extend over an arc of more than 180°, preferably should define a flange near the sidewall and a central support section in the middle of the bottom wall to provide a central support for the stack of plates.

It should be understood that the foregoing description of the invention is intended merely to be illustrative thereof and that other modifications and embodiments may be apparent to those skilled in the art without departing from its spirit.

Having thus described the invention what I desire to claim and secure by Letters Patent is:

1. A dispenser for a plurality of stacked, dish-like articles, each of which is of a predetermined depth, comprising:

a bottom wall and a side wall extending away from said bottom wall, said side wall being of a configuration corresponding substantially to that of said dish-like articles and being of a height sufficient to receive a plurality of stacked dish-like articles therein;

said bottom wall having an arcuate opening formed therein, said opening substantially paralleling said side wall and circumscribing an arc of more than 180°, said opening being defined by a pair of substantially paralleling inner and outer arcuate edges, the inner arcuate edge of said opening defining, in part, a central support region for the lowermost of the dish-like articles in the stack, the outer arcuate edge of said opening being located with respect to said stacked dish-like articles so that the peripheries of said stacked, dish-like articles lie slightly within the outer arcuate edge;

said central support region of said bottom wall extending upwardly to an extent approximately equal to said predetermined depth whereby when said dish-like articles are placed in a bottom-down configuration in said device, the central portion of the lowermost dish-like article in the stack thereof will be supported at an elevation such that the peripheral edge of said dish-like articles will be disposed approximately at the level of said bottom wall, said stack of dish-like articles being supported substantially solely by said central support region; and said side wall having a heightwise extending slot formed therein in communication with said opening in said bottom wall.

2. A device as defined in claim 1 further comprising:

retaining means secured to the inner surface of said sidewall and extending inwardly therefrom for engaging the periphery of a plurality of said plates.

3. A device as defined in claim 2 wherein said retaining means comprises brush-like members extending inwardly toward the periphery of said stacked dishes.

4. A device as defined in claim 1 further comprising:

means for detachably connecting a plurality of feet to said bottom wall of said container;

a cover detachably connected to the upper end of said sidewall; and said cover being constructed as to enable it to be secured to a supporting structure.

5. The dispenser as defined in claim 1 wherein said opening in said bottom wall is disposed symmetrically with respect to said slot in said side wall.

6. A dispenser for a plurality of stacked, dish-like articles, each of which is of a predetermined depth, comprising:

a bottom wall and a side wall extending away from said bottom wall, said side wall being of a configuration corresponding substantially to that of said dish-like articles and being of a height sufficient to receive a plurality of stacked dish-like articles therein;

said bottom wall having an arcuate opening formed therein, said opening substantially paralleling said side wall and circumscribing an arc of more than 180°, said opening being defined by a pair of substantially paralleling inner and outer arcuate edges, the inner arcuate edge of said opening defining, in part, a central support region for the lowermost of the dish-like articles in the stack, the outer arcuate edge of said opening being located with respect to said stacked dish-like articles so that the peripheries of said stacked, dish-like articles lie slightly within the outer arcuate edge;

a raised member secured to the central support region of the bottom wall and extending upwardly therefrom, the height of the raised member being approximately equal to said predetermined depth whereby when said dish-like articles are placed in a bottom-down configuration in said device, the central portion of the lowermost dish-like article in the stack thereof will be supported at an elevation such that the peripheral edges of said dish-like articles will be disposed approximately at the level of said bottom wall, said stack of dish-like articles being supported substantially solely by said raised member; and said side wall having a heightwise extending slot formed therein in communication with said opening in said bottom wall.

7. The dispenser as defined in claim 6 wherein said support member comprises a flexible, brush-like member.

* * * * *